United States Patent [19]

Summers

[11] 3,932,230

[45] Jan. 13, 1976

[54] METHOD OF EXTRACTING GALLIUM

[75] Inventor: Steven William Summers, Hazlemere, England

[73] Assignee: The British Aluminium Company Limited, London, England

[22] Filed: July 19, 1974

[21] Appl. No.: 490,031

[30] Foreign Application Priority Data

July 19, 1973 United Kingdom ..... 34480/73

[52] U.S. Cl. ..... 204/105 R; 75/93 R; 75/94; 75/63; 75/64

[51] Int. Cl.[2] ..... C25C 1/22; C22B 25/08

[58] Field of Search ..... 75/63–64, 93 R–94; 204/105 R

[56] References Cited

UNITED STATES PATENTS 1,855,455 4/1932 McCutcheon ..... 204/105 R 2,150,353 3/1939 Behr ..... 75/63

OTHER PUBLICATIONS

Periodic Table of the Elements.

*Primary Examiner*—R. L. Andrews

*Attorney, Agent, or Firm*—Karl W. Flocks

[57] ABSTRACT

A method of removing gallium from tin, lead or tin-lead alloy in which the molten metal containing gallium is treated with a molten flux of alkali metal hydroxide, alkali metal carbonate or a mixture of such constituents where the alkali metal is lithium, sodium, potassium or a mixture of these. Preferably the metal and flux are stirred together, then separated, and the flux dissolved in water and gallium recovered from the solution by electrolysis.

8 Claims, No Drawings

METHOD OF EXTRACTING GALLIUM

BACKGROUND OF THE INVENTION

In commonly assigned U.S. application Ser. No. 490,034 of even date, for a method of extracting gallium from Aluminate Solutions (based on British Application 34480/73) there is described and claimed a method of recovering gallium from aluminate liquors by electrolysis using a solid cathode made of a metal into which gallium diffuses. Preferred metals for the cathode are lead, tin and tin-lead alloys.

The present invention is concerned with the recovery of gallium from lead, tin and tin-lead alloys, particularly such alloys which have gallium absorbed into them in a percentage of from about 0.1 to 4% by weight.

SUMMARY OF THE INVENTION

An object of the present invention is to provide a simple and relatively inexpensive method for recovering gallium from tin, lead and tin-lead alloys.

Accordingly the present invention provides a method of removing gallium from a metal selected from the group tin, lead and tin-lead alloy which comprises treating the metal in molten form with a molten flux selected from the group consisting of alkali metal hydroxide, alkali metal carbonate and a mixture of such constituents and in which the alkali metal is selected from the group consisting of lithium, sodium, potassium and a mixture of such constituents.

I have found that the gallium is absorbed into the flux with only a minor proportion of the tin or lead also being absorbed. The flux containing the gallium can then be easily separated from the remainder of the metal and the gallium recovered. Preferably this is done by dissolving the flux in water to provide an alkali metal gallate solution from which the gallium is recovered by electrolysis. An alkali metal chloride may be included as a non-fuming melting point depressant in the flux.

In the preferred form, a molten flux consisting of 100% sodium hydroxide is employed. This compound melts at 320°C although the various mixtures when used in substantially eutectic proportions enables the process to be used over a temperature range of 220°–860°C. Alkali hydroxides would not ordinarily be selected for use when tin is present but in the present case hydroxides not only contribute to the low melting point of the possible mixtures which may be used, but would seem to react selectively with the gallium present to an extent whereby attack upon the tin is reduced to and acceptably low level.

It is found that stirring of the molten flux-molten metal interface substantially enhances the removal of gallium from the other metallic components present. For an efficient separation of gallium from tin, lead or tin-lead alloys contact times between the molten constituents and the length of time for which the constituents are stirred is unlimited. Although experimentally 2–60 minutes contact between the molten metal and molten flux with stirring was found sufficient.

DETAILED DESCRIPTION OF PREFERRED EMBODIMENT

In one manner of applying the process the tin, lead or tin-lead alloy containing 1–4% gallium is placed in a suitable container such as a nickel or carbon crucible.

The aforementioned ingredients of the flux are placed on top of the metal and the crucible heated in a furnace to melt the metal and the flux. A stirrer is introduced and the metal stirred to improve the flux/metal contact. After the requisite time the stirrer is removed and the crucible taken from the furnace. When cooling has progressed sufficiently for the flux, which floats on the surface of the metal, to have solidified and whilst the metal is till molten, a hole is made in the solid flux and the metal poured off. The flux is then broken up and dissolved in water to yield a solution containing sodium gallate. Gallium is readily recovered in the metallic form from this solution by the known process of electrolysis between two suitable, inert electrodes. In a further working of the process the molten tin may be passed dropwise through a column of the molten flux.

The following Examples illustrate the working of the process:

EXAMPLE 1

295.68 G of tin-gallium (1.95%) alloy was melted under 30 g of sodium hydroxide at 340°C for 30 minutes with stirring. At the end of the experiment the flux was dissolved in 250 $cm^3$ of distilled water and the solution analysed for both tin and gallium. This solution was found to contain 24.0 g/l gallium and 3.16 g/l tin which is equivalent to a 100% and 0.28% removal of gallium and tin respectively from the original alloy. A proportion of the metal analysed after treatment contained less than 0.05% of gallium.

EXAMPLE 2

1.397 G of tin-gallium (1.59%) alloy was melted under 10 g of sodium carbonate at 860°C for 30 minutes. At the end of the experiment the flux was dissolved in 100 $cm^3$ of distilled water and the solution analysed for tin and gallium. It was found that virtually 100% of the gallium had been recovered together with 21.6% of the tin.

EXAMPLE 3

1.027 G of tin-gallium (1.59%) alloy was melted under 10 g of flux consisting of 40% sodium hydroxide and 60% sodium carbonate at 540°C for 30 minutes with stirring. At the end of the experiment the flux was dissolved in 100 $cm^3$ of distilled water and the solution analyzed for tin and gallium. It was found that 100% gallium and 1.1% tin had been recovered in the flux.

EXAMPLE 4

10.004 G of tin-lead (40%) alloy containing 2% gallium was melted under 10 g of sodium hydroxide at 340°C for 30 minutes with stirring. At the end of the experiment the flux was dissolved in 100 $cm^3$ of distilled water and the solution analysed for tin, lead and gallium. The solution was found to contain 209 g/l gallium, 1.21 g/l tin and less than 0.01 g/l lead which is equivalent to 100% recovery of gallium and 1.21% removal of the tin-lead alloy present.

EXAMPLE 5

1.302 G of tin-gallium (30%) alloy was melted under 10 g of a flux of 5 g of sodium hydroxide and potassium hydroxide respectively at 200°C for 30 minutes with stirring. At the end of the experiment the flux was dissolved in 10 $cm^3$ of distilled water and the solution analysed for tin and gallium. It was found that 98% of the gallium had been recovered and 0.07% of the tin removed.

We claim:

1. A method of removing gallium from a metal selected from the group consisting of tin, lead, and tin-lead alloy which comprises treating the metal in molten form with a molten flux consisting essentially of alkali metal hydroxide, and removing the flux containing gallium from the remainder of the metal.

2. A method according to claim 1 in which the flux additionally includes alkali metal chloride as a non-fuming melting point depressant.

3. A method according to claim 1 in which the molten flux consists of 100% sodium hydroxide.

4. A method according to claim 1 which comprises maintaining the molten flux and the molten metal in the temperature range 220° to 860°C.

5. A method according to claim 1 which includes stirring the molten flux and molten metal to improve the contact therebetween.

6. A method according to claim 1, in which the flux is cooled to a solid state and the metal remainder poured off while still molten.

7. A method according to claim 1, which comprises dissolving the separated flux in water to produce an alkali metal gallate solution.

8. A method according to claim 7, which comprises removing the gallium from said solution by electrolysis between suitable inert electrodes.

* * * * *